US009368902B2

(12) United States Patent
Nakai et al.

(10) Patent No.: US 9,368,902 B2
(45) Date of Patent: Jun. 14, 2016

(54) CONNECTOR

(71) Applicant: Yazaki Corporation, Tokyo (JP)

(72) Inventors: Satoshi Nakai, Shizuoka (JP); Toru Suzuki, Shizuoka (JP); Madoka Ooishi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/696,532

(22) Filed: Apr. 27, 2015

(65) Prior Publication Data

US 2015/0229067 A1 Aug. 13, 2015

Related U.S. Application Data

(63) Continuation of application No. PCT/JP2013/078577, filed on Oct. 22, 2013.

(30) Foreign Application Priority Data

Oct. 30, 2012 (JP) ..... 2012-238931

(51) Int. Cl.

| | |
|---|---|
| ***H01R 13/52*** | (2006.01) |
| ***H01R 13/6581*** | (2011.01) |
| *H01R 13/512* | (2006.01) |
| *H01R 103/00* | (2006.01) |

(52) U.S. Cl.

CPC ..... *H01R 13/5202* (2013.01); *H01R 13/5213* (2013.01); *H01R 13/6581* (2013.01); *H01R 13/512* (2013.01); *H01R 13/5208* (2013.01); *H01R 2103/00* (2013.01); *H01R 2201/20* (2013.01)

(58) Field of Classification Search

CPC ..... H01R 13/5202; H01R 13/5213; H01R 13/5208

See application file for complete search history.

(56) References Cited

U.S. PATENT DOCUMENTS

| | | | | |
|---|---|---|---|---|
| 5,420,920 | A | 5/1995 | Capper et al. | |
| 5,888,107 | A * | 3/1999 | Seymour | H01R 13/04 439/866 |
| 7,422,494 | B2 * | 9/2008 | Fry, Jr. | H01R 13/15 439/891 |
| 7,976,353 | B2 * | 7/2011 | Myer | H01R 13/04 439/891 |

(Continued)

FOREIGN PATENT DOCUMENTS

| | | |
|---|---|---|
| JP | 8-8000 A | 1/1996 |
| JP | 10-83847 A | 3/1998 |

(Continued)

OTHER PUBLICATIONS

International Search Report for PCT/JP2013/078577 dated Jan. 28, 2014 English Translation.

(Continued)

*Primary Examiner* — Ross Gushi

(74) *Attorney, Agent, or Firm* — Sughrue Mion, PLLC

(57) ABSTRACT

A connector according to an aspect of the invention is a connector provided with a rear connector that includes a rear housing, and a front connector that includes a front housing and that is assembled to the rear connector; the rear housing contains a terminal of a cable end, and the front housing contains a mating terminal to be connected to the terminal; and the rear housing is provided with a checking window through which the terminal is exposed to outside and a voltage of the terminal can be checked, and a waterproof lid which closes the checking window in a sealed state.

5 Claims, 6 Drawing Sheets

(56) References Cited

U.S. PATENT DOCUMENTS

| | | | | |
|---|---|---|---|---|
| 8,485,844 | B2 * | 7/2013 | Omae | H01R 13/5202 439/559 |
| 9,017,090 | B2 * | 4/2015 | Matsumoto | H01R 13/6275 439/350 |
| 9,071,011 | B2 * | 6/2015 | Matsumoto | H01R 13/639 |
| 9,077,116 | B2 * | 7/2015 | Pamart | H01R 9/032 |
| 9,147,971 | B2 * | 9/2015 | Osada | H01R 13/641 |
| 9,172,187 | B2 * | 10/2015 | Miyakawa | H01R 13/629 |
| 9,209,561 | B2 * | 12/2015 | Miyakawa | H01R 13/6273 |
| 9,209,582 | B2 * | 12/2015 | Kashiwada | H01R 13/6315 |
| 2001/0055922 | A1 * | 12/2001 | Kuhnel | H01R 13/6633 439/877 |
| 2009/0137153 | A1 * | 5/2009 | Yoshioka | H01R 4/185 439/607.24 |
| 2012/0094537 | A1 * | 4/2012 | Aoki | H01R 13/688 439/620.26 |
| 2013/0065426 | A1 * | 3/2013 | Yamashita | H01R 13/6315 439/449 |
| 2013/0316573 | A1 * | 11/2013 | Uno | H01R 11/12 439/573 |
| 2014/0004740 | A1 * | 1/2014 | Uno | H01R 13/6592 439/607.58 |
| 2014/0120763 | A1 * | 5/2014 | Itsuki | H01R 13/5825 439/382 |
| 2014/0120767 | A1 * | 5/2014 | Itsuki | H01R 13/5208 439/587 |
| 2015/0229067 | A1 * | 8/2015 | Nakai | H01R 13/5202 439/587 |
| 2015/0311633 | A1 * | 10/2015 | Miklinski | H01R 13/6273 439/345 |

FOREIGN PATENT DOCUMENTS

| | | | |
|---|---|---|---|
| JP | 10189147 | A | 7/1998 |
| JP | 2008047339 | A | 2/2008 |
| JP | 2010-272404 | A | 12/2010 |
| JP | 2011-119120 | A | 6/2011 |
| JP | 2012069596 | A | 4/2012 |
| JP | 2012-124075 | A | 6/2012 |
| JP | 2012126267 | A | 7/2012 |

OTHER PUBLICATIONS

Communication dated Apr. 5, 2016 issued by the Japanese Patent Office in Application No. 2014-544443.

Communication dated Apr. 29, 2016 from the European Patent Office in a counterpart Application No. 13 85 0573.0.

* cited by examiner

CONNECTOR

CROSS REFERENCE TO RELATED APPLICATIONS

This application is a Continuation of PCT Application No. PCT/JP2013/078577, filed on Oct. 22, 2013, and claims the priority of Japanese Patent Application No. 2012-238931, filed on Oct. 30, 2012, the content of both of which is incorporated herein by reference.

TECHNICAL FIELD

The present invention relates to a connector which makes it possible to perform a continuity check and a voltage measurement of a terminal contained in a connector housing.

BACKGROUND ART

In Patent Literature 1, a waterproof shield connector is proposed. This waterproof shield connector is configured such that a terminal contained in a connector housing and a cable end swage-connected to this terminal are covered by first and second sealing members; and, in such a state, the terminal tip, which breaks through the first sealing member and projects to outside, is inserted into an insertion opening of a chassis to be connected to an electric circuit in the chassis. Further, in this waterproof shield connector, the connector housing, the first and second sealing members, the terminal, and a joint portion between the terminal and the cable end are totally shielded by a shield shell.

A continuity check and a voltage measurement of a cable are required to be made for such a connector. In this case, a probe of a measurement instrument is brought into contact with a joint portion between a cable end and a terminal.

As in the above Patent Literature 1, however, if the joint portion between the cable end and the terminal is covered by the first and second sealing members, it is difficult to bring a probe of a measurement instrument into contact with the joint portion between the cable end and the terminal. Hence, when performing the continuity check and/or the voltage measurement, it is necessary to expose the joint portion between the cable end and the terminal to outside by removing the shield shell and the first and second sealing members, and then, bring the probe of the measurement instrument into contact with the exposed portion.

Further, in order to realize the waterproof of such a joint portion between a cable end and a terminal, a type of waterproof connector in which a potting agent is used, and another type of waterproof connector in which the terminal and a portion of the cable end are molded integrally with a connector housing, are also proposed. In such a waterproof connector, however, the terminal and the portion of the cable end are not exposed to outside, and thus, as in the Patent Literature 1, it is impossible to perform the continuity check and the voltage measurement.

CITATION LIST

Patent Literature

Patent Literature 1: Japanese Patent Laid-Open Publication NO. 2010-272404

SUMMARY OF INVENTION

Technical Problem

As described above, for such a waterproof shield connector disclosed in Patent Literature 1, in case of performing the continuity check or the voltage measurement, the terminal and the joint portion between the cable end and the terminal are necessary to be exposed to outside by removing the first and second sealing members, and thus, it is troublesome to perform the continuity check and the voltage measurement.

Further, in a type of waterproof connector filled with a potting agent or another type of waterproof connector integrally molded with a connector housing, it is impossible to perform the continuity check and the voltage measurement.

Thus, the present invention is intended to provide a connector which makes it possible to realize reliable waterproof performance and to easily perform a continuity check and a voltage measurement.

Solution to Problem

A connector according to an aspect of the present invention is a connector provided with a rear connector that includes a rear housing, and a front connector that includes a front housing and that is assembled to the rear connector; the rear housing contains a terminal of a cable end, and the front housing contains a mating terminal to be connected to the terminal; and the rear housing is provided with a checking window through which the terminal is exposed to outside and a voltage of the terminal can be checked, and a waterproof lid which closes the checking window in a sealed state.

In the connector according to the aspect of the present invention, preferably, the checking window is formed of a viewing through-hole which is provided in the rear housing and through which the terminal in the rear housing can be visually recognized externally, and a tube wall which is extended from an opening edge portion of the viewing through-hole; and the waterproof lid is fit to an inside surrounded by the tube wall, in a sealed state.

Preferably, the connector according to the aspect of the present invention further includes a shield shell that covers an outer circumference of the rear connector to shield the rear connector, and the shield shell is provided with an insertion through-hole through which the tube wall is inserted. Further, preferably, the waterproof lid includes a waterproof plug body which is fit to the tube wall inserted through the insertion through-hole, a seal member which is assembled to the waterproof plug body and closely contacts with an inner circumference of the tube wall, a lid plate to which the waterproof plug body is assembled, and which is fixed to the rear housing, and a fixing bolt by which the lid plate is screwed and fixed to the rear housing.

In the connector according to the aspect of the present invention, preferably, the rear housing and the terminal are integrally molded, and the viewing through-hole provided in the rear housing is a hole formed by an extrusion pin which is butted against the terminal and extrudes the rear housing from a molding die when the rear housing and the terminal are integrally molded.

In the connector according to the aspect of the present invention, preferably, the rear housing and the terminal are integrally molded.

DESCRIPTION OF EMBODIMENTS

Hereinafter, a connector 2 according to an embodiment of the present invention will be described with reference to the drawings. The connector 2 according to this embodiment is a connector for connecting a power control electric device (invertor) 9 (refer to FIG. 3) to a cable 11, and supplies electric power from a power source to the power control electric device 9 by being disposed between the power control electric device 9 and the cable 11.

Figure 1:
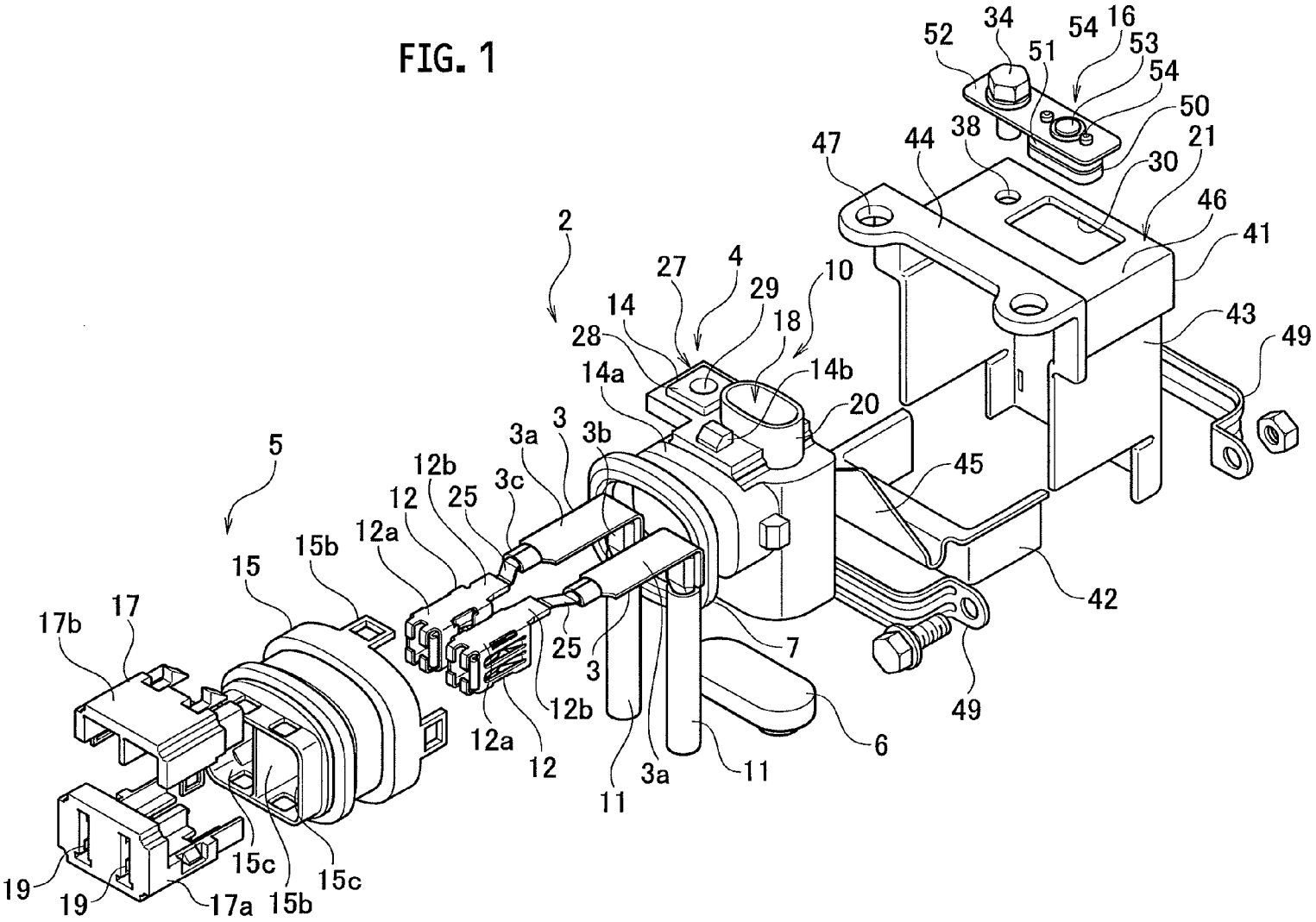
FIG. 1 is an exploded perspective view illustrating a connector according to an embodiment of the present invention.

As shown in FIG. 1, the connector 2 according this embodiment includes a rear connector 4 including a rear housing 14; a front connector 5 which includes a front housing (front housing body) 15 and is assembled to the rear connector 4; and a shield shell 21 which covers the outer circumference of the rear connector 4 to shield the rear connector 4. The rear housing 14 contains terminals (hereinafter, each referred to as a "plate-like terminal") 3 attached to the ends of the cables 11, and the front housing 15 contains mating terminals each connected to a corresponding one of the plate-like terminals 3. The rear housing 14 and the front housing 15 constitute a connector housing.

FIG. 1 illustrates an exploded perspective view of the connector 2 according to this embodiment. The rear housing 14 and the plate-like terminals 3 may be molded as mutually separated components, and then, the molded terminals 3 may be assembled to the molded rear housing 14. Alternatively, the rear housing 14 and the plate-like terminals 3 may be mutually integrally molded. In the following description, a case where the rear housing 14 and the plate-like terminals 3 are integrally molded will be described. A method of integrally molding the rear housing 14 and the plate-like terminals 3 will be described below.

In the connector 2 according to this embodiment, the rear housing 14 is provided with a checking window 10, through which the plate-like terminals 3 are exposed to outside and voltages of the plate-like terminals 3 can be checked, and a waterproof lid 16 which closes the checking window 10 in a sealed state.

The plate-like terminals 3 are each connected to a corresponding one of the ends of the cables 11 from a power source. In this embodiment, the cable 11 is formed of a pair of core wires (two core wires), and the plate-like terminals 3 are connected to the ends of the cables 11, respectively. As shown in FIG. 1, each of the plate-like terminals 3 is formed of a terminal body 3*a*; a cable-side connection portion 3*b* which is bent at a right angle from the terminal body 3*a* and which is connected to the end of an internal conductor of the cable 11 by being swaged and crimped thereto; and a female-terminal-side connection portion 3*c* which is formed integrally with an opposite side end of the terminal body 3*a* from the cable-side connection portion 3*b* and which is connected to a female terminal 12 described below by being swaged and welded thereto.

The rear connector 4 includes the rear housing 14, and this rear housing 14 contains therein the plate-like terminals 3 and end portions of the cable 11 connected to the plate-like terminals 3. The rear housing 14 is formed of an insulating resin. In this rear housing 14, an attaching portion 14*a* of a long cylindrical outer shape, to which the front connector 5 is assembled, is integrally provided at the front side of the rear housing 14 and, on the outer face of this attaching portion 14*a*, latching convex portions 14*b* for assembling to the front connector 5 are formed. This rear housing 14 is not molded in advance, but is integrally molded, inside a molding die, together with a mold waterproof portion 6 described below during manufacturing of the connector 2, and results in a configuration shown in FIGS. 2 to 6 through the integral molding.

Figure 4:
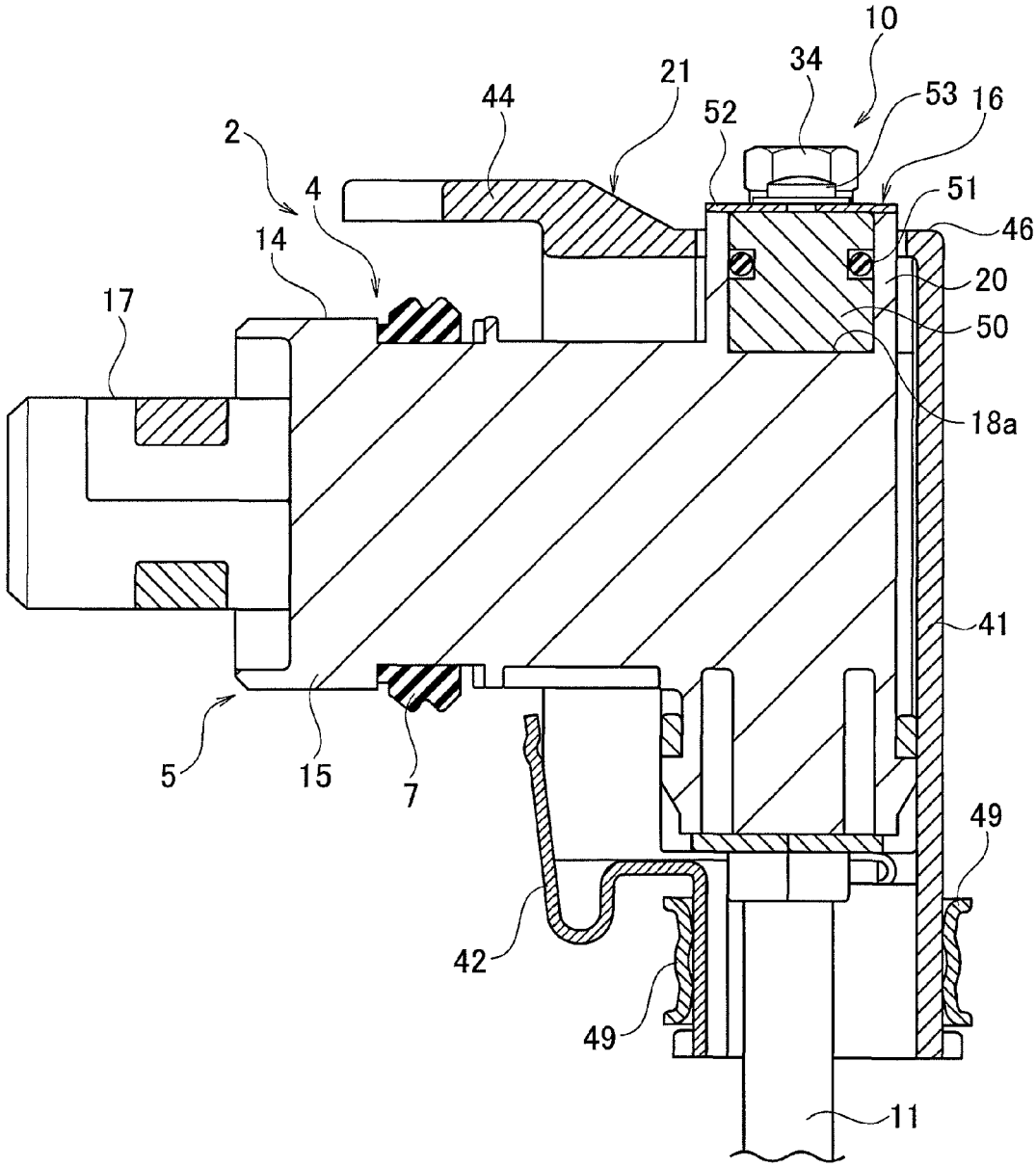
FIG. 4 is a cross-sectional view taken along the line IV-IV of FIG. 2.
Figure 5:
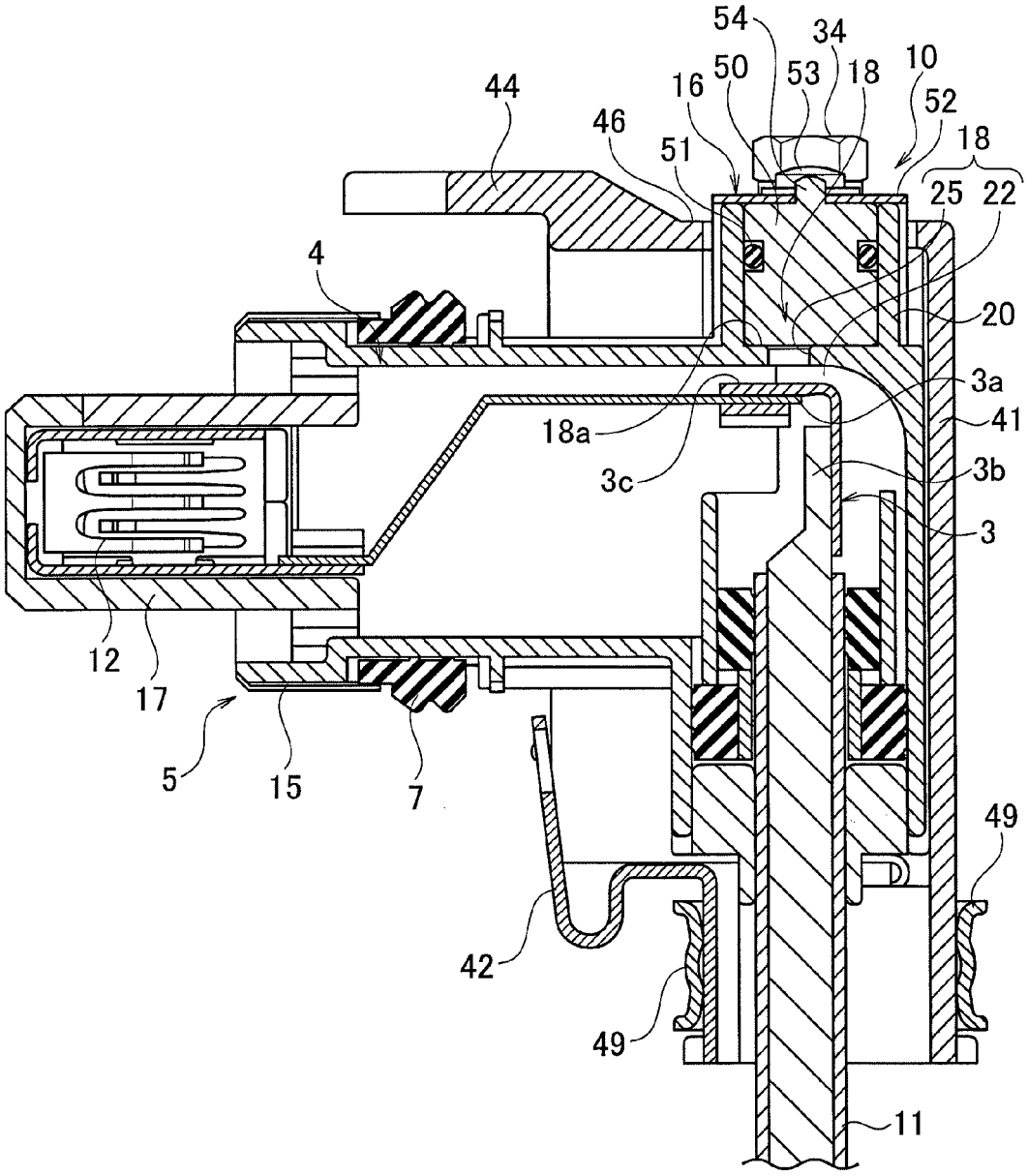
FIG. 5 is a cross-sectional view taken along the line V-V of FIG. 2.

Further, as shown in FIGS. 1, 4, and 5, the checking window 10 provided in the rear housing 14 is formed of a viewing through-hole 18 through which the plate-like terminals 3 in the rear housing 14 can be visually recognized externally, and a tube wall 20 which is extended from an opening edge portion 18*a* of the viewing through-hole 18. The viewing through-hole 18 is formed of an internal through-hole 22 provided in the mold waterproof portion 6 molded integrally with the plate-like terminals 3, and an external through-hole 25 which is provided in the rear housing 14 and which communicates with the internal through-hole 22. Each of the internal through-hole 22 and the external through-hole 25 is provided at two positions, corresponding to the terminal body portions 3*a*, 3*a* of the two plate-like terminals 3, 3, respectively.

These internal through-hole 22 and external through-hole 25 are formed by utilizing a hole which is formed by a butting pin butted against the plate-like terminals 3 when the rear housing 14, the mold waterproof portion 6, and the plate-like terminals 3 are integrally molded. Further, the above-described tube wall 20 is provided so as to project from the opening edge portion 18*a* of the external through-hole 25.

Figure 6:
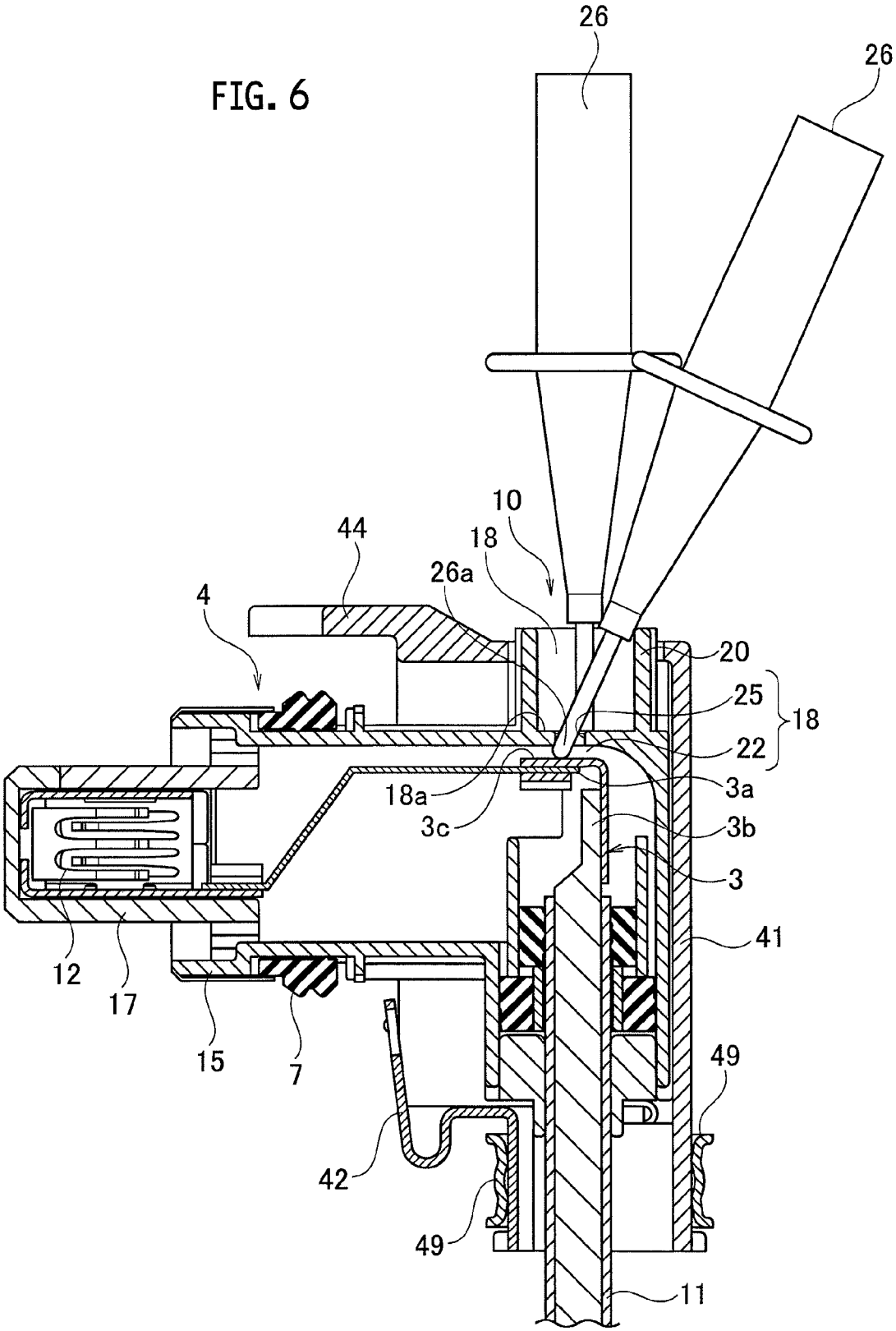
FIG. 6 is a cross-sectional view illustrating a state in which a continuity check or a voltage measurement is performed through a checking window.

The tube wall 20 is formed in an oval shape in a planar view, and the height thereof is set such that, as shown in FIG. 6, a tip 26*a* of a probe 26 of a measurement instrument for the continuity check or the voltage measurement can be inserted into the external through-hole 25 in the tube wall 20, and into the internal through-hole 22. Moreover, a screw fixing portion 27 is provided in the rear housing 14 adjacent to the tube wall 20. This screw fixing portion 27 is formed of a rectangular-shaped mounting table 28 which is formed so as to be higher than the outer circumference face of the rear housing 14 by one step, and a screw fixing hole 29 which is formed at the center of the mounting table 28. These tube wall 20 and screw fixing portion 27 are covered by the shield shell 21 for covering the outer circumference of the rear connector 4 to electromagnetically shield the rear connector 4, and the tube wall 20 projects to outside through a rectangular-shaped insertion through-hole 30 provided in the shield shell 21. Further, a screw insertion hole 38 is formed adjacent to the rectangular-shaped insertion through-hole 30 of the shield shell 21. A fixing bolt 34 screwed into the screw fixing hole 29 of the mounting table 28 is inserted through the screw insertion hole 38. Further, the above-described waterproof lid 16 is fit to an inside surrounded by the tube wall 20, in a sealed state.

The waterproof lid 16 is formed of a waterproof plug body 50 which is fit into the tube wall 20; a seal member (O ring) 51 which is assembled to the waterproof plug body 50 and closely contacts with the inner circumference of the tube wall 20; a lid plate 52 to which the waterproof plug body 50 is assembled and which is screwed and fixed to the rear housing 14; and a fixing bolt 34 which fixes the lid plate 52 to the rear housing 14. The waterproof plug body 50 is fixed to the lid plate 52 by a fixing screw 53, and is position-adjusted relative to the lid plate 52 by using positioning projections 54 projecting from the waterproof plug body 50 at both sides of the fixing screw 53.

Further, as shown in FIG. 5, in the state in which a head portion of the tube wall 20 projects from the rectangular-shaped insertion through-hole 30 provided in the shield shell 21 and the lid plate 52 is fixed to the rear housing 14 by fixing the lid plate 52 to the mounting table 28 by using the fixing bolt 34, the lid plate 52 comes into contact with the end face of the tube wall 20 projecting from the shield shell 21. In this state, the waterproof plug body 50 is fit to the inside of the tube wall 20 and the seal member 51 is in close contact with the inner wall of the tube wall 20. Thus, the waterproof performance is ensured.

The shield shell 21 covers the outer circumference of the rear connector 4, and is formed of an upper shell 41 and an under shell 42 each of which is made of metal, such as aluminum.

The upper shell 41 is formed of a box-shaped outer circumference shield wall 43 which contains the rear connector 4, and a fixing portion 44 which is integrally molded so as to extend in a lateral direction on the upper face of the outer circumference shield wall 43. The fixing portion 44 is a member for fixing the upper shell 41 to an electric-device case (not illustrated) of an electric device, and has fixing through-holes 47, through each of which a fixing bolt penetrates, formed on both right and left sides of the fixing portion 44 (refer to FIG. 1). Further, the upper shell 41 is provided, on an upper face 46, with the above-described rectangular-shaped insertion through-hole 30 and the screw insertion hole 38 adjacent to the insertion through-hole 30.

The under shell 42 is formed in a U shape, and is assembled to a lower portion of the upper shell 41. This assembling is performed by using a pair of holding brackets 49. This pair of holding brackets 49 is provided so as to sandwich the lower portion of the upper shell 41 and the under shell 42. The upper shell 41 and the under shell 42 are assembled to each other by, in the state in which the under shell 42 is in contact with the lower portion of the upper shell 41, sandwiching these by the pair of sandwiching brackets 49, and joining the pair of holding brackets 49 by using bolts and nuts. Through this assembling of the under shell 42 to the upper shell 41 in such a way as described above, the rear housing 14 is contained inside the shield shell 21 and enters a shielded state.

The front connector 5 is formed of a front housing body 15 (front housing) and a housing front 17.

The front housing body 15 contains the pair of female terminals 12. Each of the female terminals 12 is formed in a box shape, and is contained in the front housing body 15, in a state of being connected to a corresponding one of the plate-like terminals 3. In the front housing body 15, in order to contain the female terminals 12, terminal container chambers 15*c* are formed. The terminal chambers 15*c* are partitioned by a partition wall 15*a*, and this partition wall 15*a* prevents a mutual contact between the female terminals 12 each inserted into a corresponding one of the terminal chambers 15*c*. The front housing body 15 is assembled to the attaching portion 14*a* of the rear housing 14, and hook portions 15*b*, each of which is associated with a corresponding one of the latching convex portions 14*b* of the attaching portion 14*a*, project toward the rear housing 14.

The housing front 17 is inserted with mating terminals of the power control electric device. The housing front 17 includes a lower front portion 17*a* and an upper front portion 17*b*, which are capable of being assembled to each other. In the lower front portion 17*a*, mating terminal insertion openings 19, into each of which a corresponding one of plate-like mating terminals (omitted from illustration) from the power control electric device is inserted, are formed. Each of the mating terminals inserted into a corresponding one of the mating terminal insertion openings 19 is electrically connected to a corresponding one of the box-shaped female terminals 12 contained in the front housing body 15.

The mold waterproof portion 6 is molded integrally with a surrounding portion of the cable 11. The mold waterproof portion 6 is provided so as to surround the surrounding portion of the cable 11 including a pair of core wires, and blocks water running on an insulating outer coat of the cable 11 from moving to the plate-like terminal 3 side. In this way, it is possible to prevent the intrusion of water from the surrounding portion of the cable 11.

Figure 2:
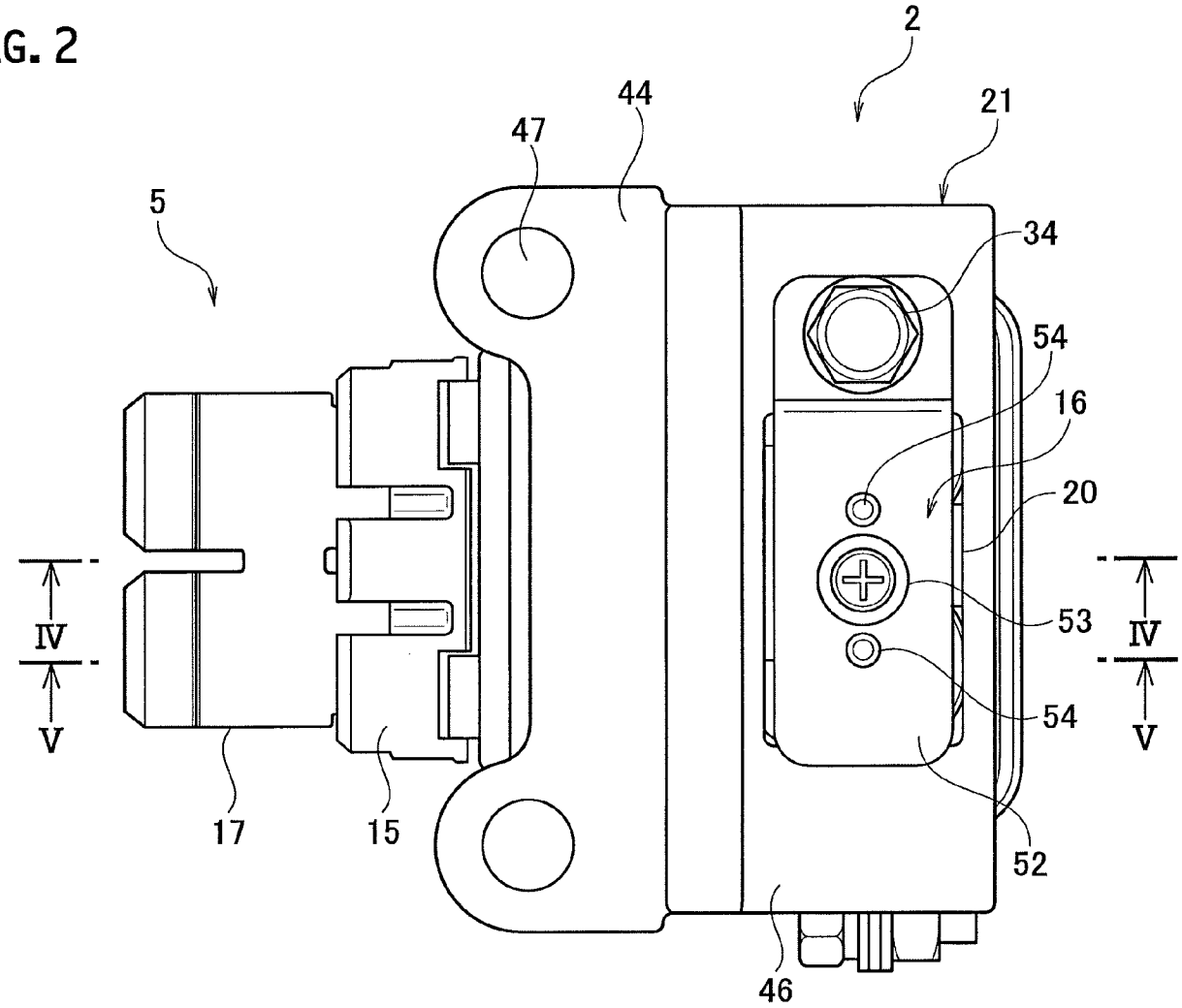
FIG. 2 is a plan view illustrating an assembled state of a connector according to an embodiment of the present invention.
Figure 3:
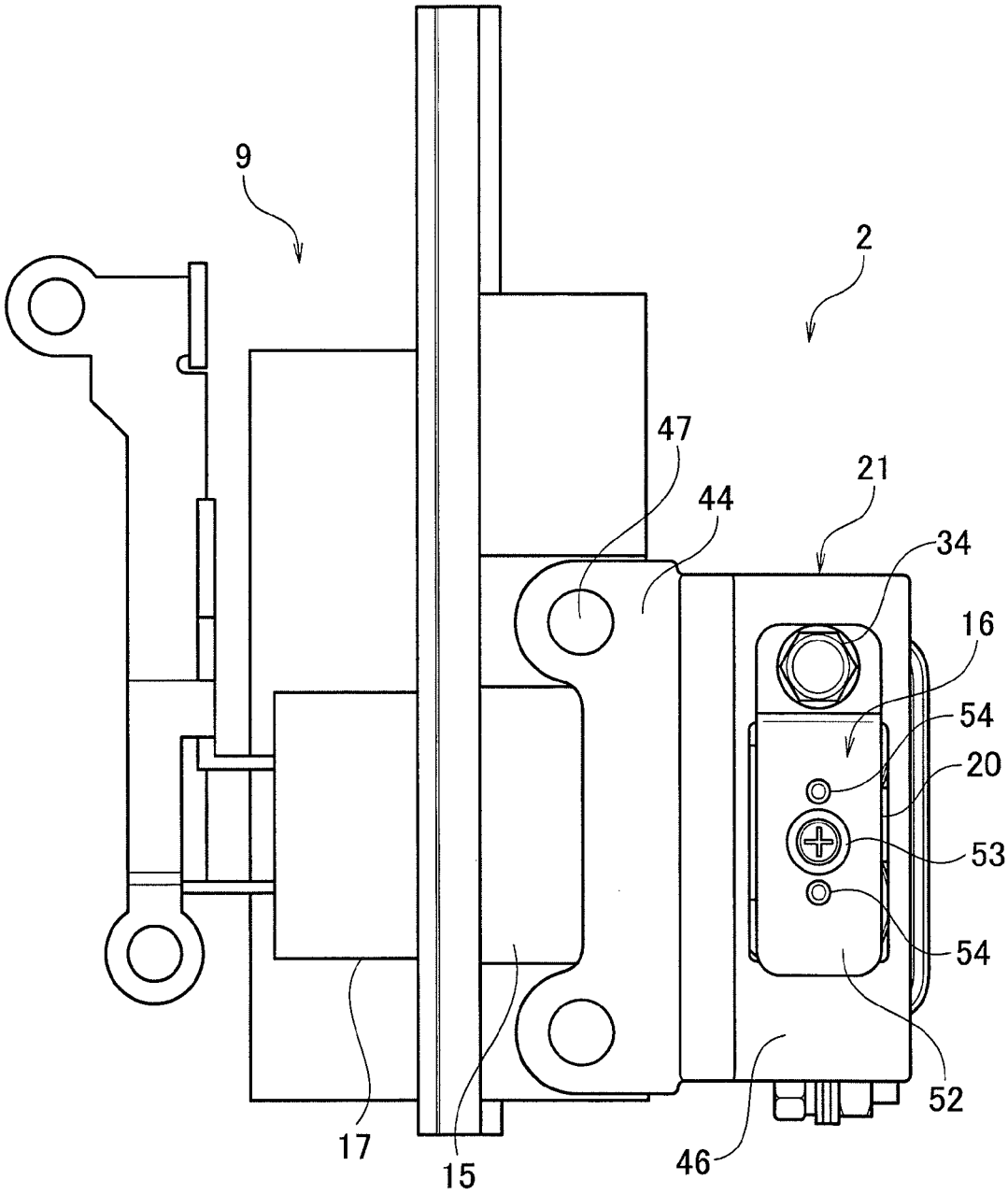
FIG. 3 is a plan view illustrating a state in which a connector according to an embodiment of the present invention is attached to a power control electric device (invertor), in an assembled state.

The mold waterproof portion 6 is not molded in advance, but is integrally molded inside a molding die during manufacturing of the connector 2. FIGS. 2 to 4 illustrate a configuration of the mold waterproof portion resulting from integral molding. Through such integral molding, the mold waterproof portion 6 is integrated with the cable 11, and thus, the mold waterproof portion 6 is joined with the cable 11 more tightly, as compared with a case in which, merely, a seal ring made of rubber or the like is wound around the cable 11. Thereby, the waterproof performance is extremely improved.

As a material for the mold waterproof portion 6 such as described above, thermosetting elastomer is used. As the thermosetting elastomer, vulcanized gum or thermosetting resin elastomer can be used, and as this thermosetting resin elastomer, polyurethane rubber, silicone rubber, fluorocarbon rubber, or the like, can be optionally selected.

Hereinafter, a manufacturing method for the connector 2 according to this embodiment will be described.

Referring to FIG. 1, which illustrates a state before integral molding of the mold waterproof portion 6, each of the plate-like terminals 3 is connected to a corresponding one of ends of a pair of core wires constituting the cable 11.

The end portions of the cables 11, to each of which a corresponding one of the plate-like terminals 3 is attached, are set inside a molding die, and heat hardening is performed by injecting a thermosetting elastomer into the molding die. In this way, the mold waterproof portion 6 is molded integrally with the surrounding portion of the end portions of the cables 11.

After the integral molding of the mold waterproof portion 6, each of the box-shaped female terminals 12 is connected to a corresponding one of the plate-like terminals 3. As shown in FIG. 1, each of the female terminals 12 is formed of a female box-portion connection portion 12*a* of a box shape, and a thin-plate shaped plate-like connection portion 12*b* extended from the female box-portion connection portion 12*a*, and the female-terminal side connection portion 3*c* of the plate-like terminal 3 is swaged and crimped to the plate-like connection portion 12*b*. Thereafter, the female-terminal side connection portion 3*c* is joined with the plate-like connection portion 12*b* by welding. Through this welding, the plate-like terminal 3 and the female terminal 12 result in a state in which they are tightly connected to each other. This tight connection increases the reliability of electric connection.

FIGS. 2 to 6 illustrate a state resulting from integral molding of the rear housing 14. This integral molding of the rear housing 14 is performed after the integral molding of the mold waterproof portion 6 with the surrounding portion of the end portions of the cables 11 and the connection of the plate-like terminals 3 to the female terminals 12 by welding.

The integral molding of the rear housing 14 is performed by setting the end portions of the cables 11, around which the mold waterproof portion 6 has been formed, and the plate-like terminals 3 connected to the end portions of the cables 11 inside a molding die; injecting insulating resin into the molding die; and hardening the insulating resin. Through this molding, the mold waterproof portion 6 and the end portions of the cables 11, around which the mold waterproof portion 6 is provided, result in a state where they are embedded in the rear housing 14. Thus, the mold waterproof portion 6 results in a state being fixed inside the rear housing 14, and the separation of the mold waterproof portion 6 from the cable 11 is blocked. Accordingly, the state in which the mold waterproof portion 6 is in close contact with the surrounding portion of the cable 11 can be kept, and thus, the prevention of water intrusion can be reliably achieved by the mold waterproof portion 6.

After the integral molding of the mold waterproof portion 6 with the ends of the cables 11 and the integral molding of the rear housing 14 with the mold waterproof portion 6, the front housing body 15 is assembled to the rear housing 14. During this assembly, the front connector 5 is formed by assembling the housing front 17, and inserting the assembled housing front 17 into the front housing body 15. In addition, a seal ring 7 made of rubber is disposed between the front housing body 15 and the housing front 17.

Thereafter, the front housing body 15 is assembled to the attaching portion 14*a* of the rear housing 14 while inserting the female terminals 12 into the terminal container chamber 15*c* of the front housing body 15. At this time, each of the hook portions 15*b* is latched to a corresponding one of the latching convex portions 14*b* such that the seal ring 7 made of rubber is sandwiched therebetween.

Next, the rear connector 4 is contained in the shield shell 21. At this time, the tube wall 20 provided in the rear housing 14 is inserted through the inside of the insertion through-hole 30 of a rectangular shape. In this state, the under shell 42 is assembled to the upper shell 41 by using the holding brackets 49, and, as a result, the rear connector 4 is contained and held inside the shield shell 21. Subsequently, the waterproof plug body 50 is fit to the inside of the tube wall 20, and the seal member 51 is brought into close contact with the inner wall of the tube wall 20. Next, the fixing bolt 34 is inserted through the inside of the insertion hole 38 and is screwed into the fixing screw hole 29 of the rear housing 14. As a result, as shown in FIGS. 4 and 5, the lid plate 52 comes into contact with the end face of the tube wall 20.

In such a way as described above, the connector 2 is assembled such as shown in FIGS. 2 and 3. Next, when a continuity check or a voltage measurement is performed, as shown in FIG. 6, the fixing bolt 34 is removed from the fixing screw hole 29, and the waterproof lid 16 is removed from the inside of the tube wall 20. In the state in which the waterproof lid 16 is removed from the inside of the tube wall 20, the terminal body portions 3*a* of the plate-like terminals 3 are exposed to outside through the external through-hole 25 and the internal through-hole 22. Further, the probe 26 of a measurement instrument for the continuity check and/or the voltage measurement is inserted through the external through-hole 25 and the internal through-hole 22, and thereby, the tip 26*a* is brought into contact with one of the terminal body portions 3*a*

After the completion of the continuity check and/or the voltage measurement, the external through-hole 25 and the internal through-hole 22 are closed in a sealed state by fitting the waterproof lid 16 to the inside of the tube wall 20, and clamping the fixing bolt 34 into the fixing screw hole 29.

As described above, according to this embodiment, in the connector 2 in which the plate-like terminals 3 are contained in the rear housing 14, the checking window 10 is closed in a sealed state by the waterproof lid 16, and thus, reliable waterproof performance can be realized. Further, in the connector 2, the plate-like terminals 3 are exposed to outside by opening the checking window 10, and thus, through a method of bringing the tip 26*a* of the probe 26 of a checking instrument or a measurement instrument into contact with one of the plate-like terminals 3 through the checking window 10, the continuity check and/or the voltage measurement can be easily performed. Accordingly, the existing problem in that it is troublesome to perform the continuity check and/or the voltage measurement, as well as the existing problem in that it is difficult to make the continuity check and/or the voltage measurement, can be solved. Further, reliable waterproof performance can be realized and, simultaneously therewith, the continuity check and the voltage measurement can be easily performed.

Further, according to this embodiment, when performing the continuity check and/or the voltage measurement, the plate-like terminals 3 are exposed to outside through the viewing through-hole 18 merely by removing the waterproof lid 16 in the state of being fit to the inside of the tube wall 20 provided at the opening edge portion 18*a* of the viewing through-hole 18, and thus, the continuity check and/or the voltage measurement can be easily performed. Further, reliable waterproof performance can be realized by fitting the waterproof lid 16 to the inside of the tube wall 20.

Moreover, the waterproof plug body 50 can be removed from the inside of the tube wall 20 by removing the fixing bolt 34 which is screwed and fixed to the rear housing 14, and removing the lid plate 52 from the shield shell 21, and in this state, the plate-like terminals 3 are exposed to the outside through the internal through-hole 22 provided inside the tube wall 20. After the continuity check or the voltage measurement has been performed in such a state in which the plate-like terminals 3 are exposed to the outside, through a method of inserting the waterproof plug body 50 into the tube wall 20 again and fixing the lid plate 52 to the rear housing 14 by using the fixing bolt 34, the waterproof plug body 50 is fit to the inside of the tube wall 20 and the seal member 51 comes into close contact with the inside of the tube wall 20, thereby enabling realization of reliable waterproof performance.

Further, through a method of applying a hole, which is formed by a butting pin butted against the terminals 3 during the process of molding the rear housing 14 integrally with the terminals, to the viewing through-hole 18 through which the terminals 3 are exposed to outside in the tube wall 20, any particular through-hole for the exposure of the terminals is unnecessary to be provided in design of the rear housing 14. Through this method, the structure of a molding die for molding the rear housing becomes simple and, as a result, manufacturing costs for the die and the connector can be reduced.

Moreover, in this embodiment, the mold waterproof portion 6 is molded integrally with the surrounding portion of the ends of the cables 11, and thus, the mold waterproof portion 6 is brought into a state of being in close contact with the insulating outer coat of the cable 11 and is tightly joined with the cable 11. Thus, water running on the cable 11 is blocked by the mold waterproof portion 6, and thus, the prevention of the water intrusion can be reliably achieved. Further, since the cable 11 involving the mold waterproof portion 6 is molded integrally with the rear housing 14, the mold waterproof portion 6 is embedded integrally with the rear housing 14, and thus, the state in which the mold waterproof portion 6 is in close contact with the cable 11 can be kept. Further, this leads to increase of the power of prevention by the mold waterproof portion 6 on the water intrusion 6.

In such an embodiment as described above, a waterproof structure is realized by molding the mold waterproof portion 6 integrally with the surrounding portion of the ends of the cables 11 and molding the cable 11 involving the mold waterproof portion 6 integrally with the rear housing 14, and thus, the number of parts required to realize the waterproof structure does not increase, and the size of the connector 2 does not increase, either. Moreover, the rear housing 14 is molded integrally with the mold waterproof portion 6 and the cable 11 which have been integrally molded, and thus, the number of assembly processes decreases and the manufacturing becomes easy.

In addition, in this embodiment, a case where the cable 11 is formed of a pair of core wires has been described and, besides, the present invention can be applied to a continuity check and/or a voltage measurement on terminals connected to a coaxial cable.

Further, in this embodiment, a connector in which the rear housing 14 and the plate-like terminals 3 are integrally molded has been described and, besides, the present invention can be applied to a connector which results from molding the rear housing 14 and the plate-like terminals 3 as separated components and assembling the plate-like terminals 3 to the molded rear housing 14. That is, the present invention can be applied to all types of connector in each of which terminals are contained in a connector housing.

Hereinbefore, embodiments according to the present invention have been described, but these embodiments are just exemplifications which have been described in order to make it easy to understand the present invention, and the present invention is not limited to these embodiments. The technical scope of the present invention is not limited to the specific technical respects having been disclosed in this embodiment, but encompasses various modifications, changes, alternative technologies and the like, which can be easily derived therefrom.

INDUSTRIAL APPLICABILITY

In a connector housing containing one or more terminals, since a connector including the connector housing is configured such that a checking window is closed in a sealed state by a waterproof lid, it is possible to realize reliable waterproof performance, and since the connector is configured such that, by opening the checking window, the one or more terminals enter a state in which they are exposed to outside, it is possible to perform a continuity check and/or a voltage measurement. Accordingly, it is possible to solve an existing problem in that the continuity check and the voltage measurement are troublesome, as well as another existing problem in that it is difficult to perform the continuity check and the voltage measurement; and further, it is possible to realize reliable waterproof performance and, simultaneously therewith, perform the continuity check and the voltage measurement easily.

REFERENCE SIGNS LIST

2 connector
3 plate-like terminal
4 rear connector
5 front connector
10 checking window
14 rear housing
15 front housing
16 waterproof lid
18 viewing through-hole
30 insertion through-hole

The invention claimed is:

1. A connector comprising:
a rear connector that includes a rear housing; and
a front connector that includes a front housing and that is assembled to the rear connector,
wherein the rear housing contains a terminal of a cable end, and the front housing contains a mating terminal to be connected to the terminal, and
wherein the rear housing is provided with
a checking window through which the terminal is exposed to outside, and a voltage of the terminal can be checked, and
a waterproof lid which closes the checking window in a sealed state.

2. The connector according to claim 1,
wherein the checking window is formed of:
a viewing through-hole which is provided in the rear housing and through which the terminal in the rear housing can be visually recognized externally; and
a tube wall extended from an opening edge portion of the viewing through-hole, and
wherein the waterproof lid is fit to an inside surrounded by the tube wall, in a sealed state.

3. The connector according to claim 2, further comprising
a shield shell that covers an outer circumference of the rear connector to shield the rear connector,
wherein the shield shell is provided with an insertion through-hole through which the tube wall is inserted, and
wherein the waterproof lid includes:
a waterproof plug body which is fit to the tube wall inserted through the insertion through-hole;
a seal member which is assembled to the waterproof plug body and closely contacts with an inner circumference of the tube wall;
a lid plate to which the waterproof plug body is assembled and which is fixed to the rear housing; and
a fixing bolt by which the lid plate is screwed and fixed to the rear housing.

4. The connector according to claim 2, wherein
the rear housing and the terminal are integrally molded, and
the viewing through-hole provided in the rear housing is a hole formed by an extrusion pin which is butted against the terminal and extrudes the rear housing from a molding die when the rear housing and the terminal are integrally molded.

5. The connector according to claim 1, wherein the rear housing and the terminal are integrally molded.

* * * * *